US006961286B1

(12) United States Patent
Alagia

(10) Patent No.: US 6,961,286 B1
(45) Date of Patent: Nov. 1, 2005

(54) COMBINATION NOISE BLOCKING HEADSET AND ALARM CLOCK

(76) Inventor: Mary Alagia, 2 Horatio St. #10-S, New York, NY (US) 10014

( * ) Notice: Subject to any disclaimer, the term of this patent is extended or adjusted under 35 U.S.C. 154(b) by 66 days.

(21) Appl. No.: 10/888,669

(22) Filed: Jul. 9, 2004

(51) Int. Cl.[7] ..... G04B 47/00; G04B 23/02; F61F 1/06

(52) U.S. Cl. ..... 368/10; 368/72; 368/244; 368/278; 381/71.6

(58) Field of Search ..... 368/10, 72–74, 368/244, 250, 278; 181/129; 381/71.6

(56) References Cited

U.S. PATENT DOCUMENTS 4,148,018 A 4/1979 Koepp ..... 340/401
4,821,247 A * 4/1989 Grooms ..... 368/63
5,182,774 A * 1/1993 Bourk ..... 381/71.6
5,737,692 A 4/1998 Lang ..... 455/66
5,815,582 A * 9/1998 Claybaugh et al. ..... 381/71.6
5,894,455 A * 4/1999 Sikes ..... 368/12
6,014,345 A * 1/2000 Schmadeka ..... 368/10
6,118,878 A 9/2000 Jones ..... 381/72
6,748,087 B1 * 6/2004 Jones ..... 381/71.6

* cited by examiner

*Primary Examiner*—Vit W. Miska
(74) *Attorney, Agent, or Firm*—Goldstein Law Offices PC.

(57) ABSTRACT

A combination noise blocking headset and alarm clock, having a pair of padded earpieces for blocking out ambient noise so that a commuter can sleep or read on a subway or train without distractions, and having an alarm clock unit within one of the earpieces for waking up or alerting the user at a predetermined time.

17 Claims, 2 Drawing Sheets

COMBINATION NOISE BLOCKING HEADSET AND ALARM CLOCK

BACKGROUND OF THE INVENTION

1. Field of the Invention

The invention generally relates to a noise blocking headset, and in particular relates to a combination noise blocking headset and alarm clock, having a pair of earpieces for blocking out ambient noise so that a user can sleep or read without distractions, and having an alarm clock unit for waking up or alerting the user at a predetermined time.

2. Description of the Related Art

Commuting to work by train or subway is a time-consuming activity. Commuters often try to nap or read while commuting, in order to make better use of this time. However, because of the elevated noise levels encountered on trains and subways, especially during "rush hour", it is often difficult to either nap or to read thereon. Moreover, if the commuter does manage to drift off to sleep, he/she runs the risk of over-sleeping and missing his/her "stop". Accordingly, there is a need for a combination noise blocking headset and alarm clock, having a pair of earpieces for blocking out ambient noise so that a commuter can nap or read without distractions, and having an alarm clock for waking up or alerting the commuter at a predetermined time, so that the commuter will not miss his/her train stop.

A variety of combination earpieces and alarm clocks have been devised. For example, U.S. Pat. No. 5,737,692 to Lang appears to show a clock radio system with a remote alert device for providing an alert at a predetermined time, wherein the system is preferably inserted in the user's ear, awakening only the user. Additionally, U.S. Pat. No. 4,148,018 to Koepp appears to show an alarm sounder actuated by an alarm output source from AC powered electronic devices such as electronic clocks and capable of being incorporated in an earphone.

Moreover, U.S. Pat. No. 6,118,878 to Jones appears to show an active noise cancellation system adapted for use with a headset and which eliminates unwanted sound by propagating "anti-noise" soundwaves.

While these devices may be suitable for the particular purpose employed, or for general use, they would not be as suitable for the purposes of the present invention as disclosed-hereafter.

SUMMARY OF THE INVENTION

It is an object of the invention to provide a combination noise blocking headset and alarm clock which is capable of blocking out ambient noise of a commuter train or subway in order that a commuter will be able to nap or read without distractions. Accordingly, the combination headset and alarm clock comprises a pair of padded earpieces for effectively blocking out ambient noise so that a commuter can nap or read without distractions.

It is another object of the invention to provide a combination headset and alarm clock which is capable of waking up or alerting the commuter after a predetermined amount of time has elapsed, so that the commuter will not miss his/her train stop. Accordingly, the combination headset and alarm clock further comprises an alarm clock having an audible alarm for waking up or alerting the commuter at a predetermined time, so that the commuter will not miss his/her train stop.

It is yet another object of the invention to provide a combination headset and alarm clock that is not unduly expensive. Accordingly, the materials from which the combination headset and alarm clock is constructed are readily available and its cost is not prohibitive.

Further objects of the invention will become apparent in the detailed description of the invention that follows.

The invention is a combination noise blocking headset and alarm clock, having a pair of padded earpieces for blocking out ambient noise so that a commuter can sleep or read on a subway or train without distractions, and having an alarm clock unit within one of the earpieces for waking up or alerting the user at a predetermined time.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
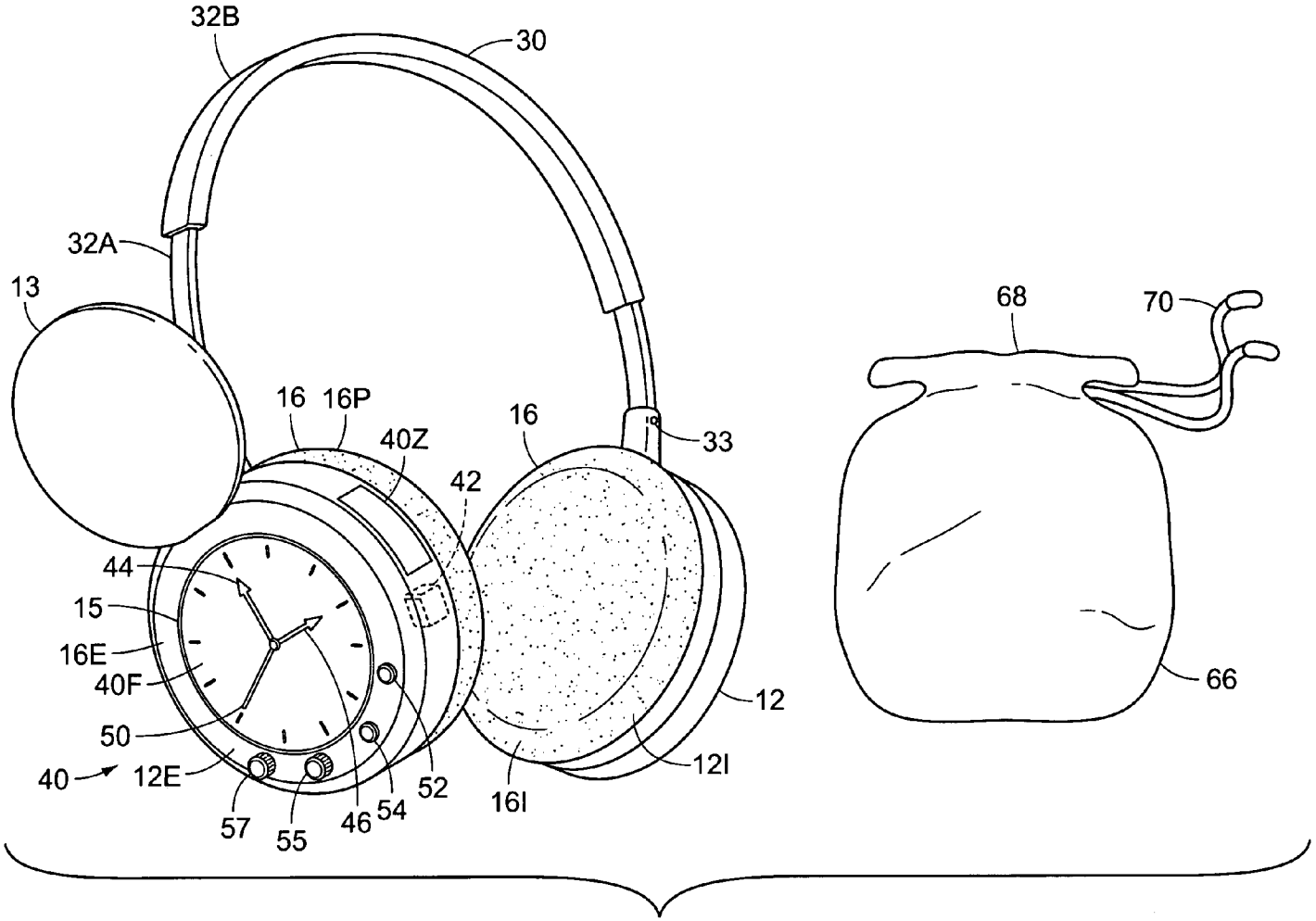
FIG. 1 is a perspective view of a combination headset and alarm clock, and a storage pouch thereof.
Figure 2:
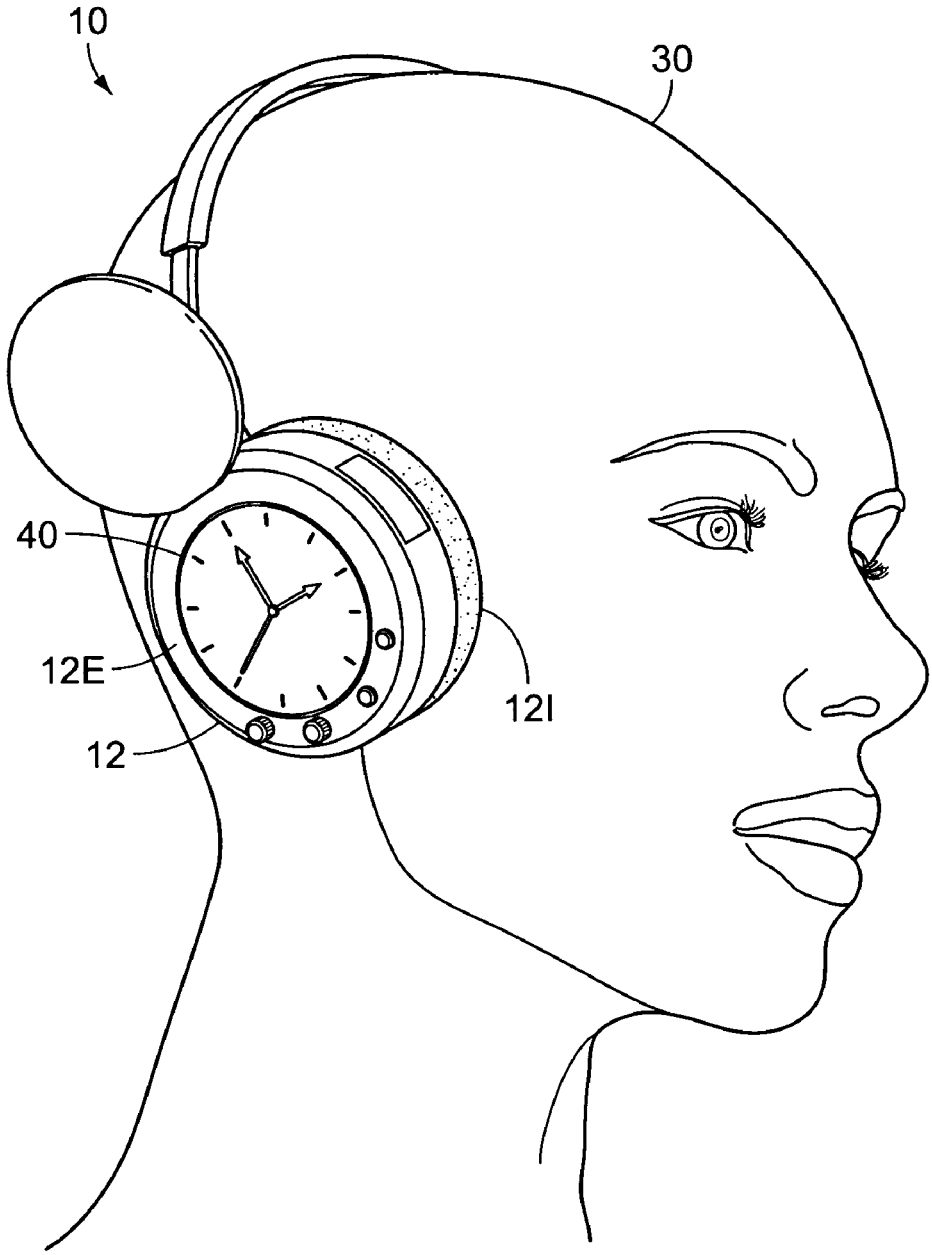
FIG. 2 is a perspective view of the combination headset and alarm clock being worn on the head of a user, wherein a flap is opened in order to reveal an alarm clock.

FIG. 1 illustrates a combination headset and alarm clock 10, for blocking out ambient noise of a subway train so that a commuter can sleep or read thereon without distractions, and for waking up or alerting the commuter after a predetermined amount of time has elapsed. The combination headset and alarm clock 10 may additionally be suitably used for any of a variety of other applications which require blocking out ambient noise and/or waking up or alerting a user after a predetermined amount of time has elapsed.

The combination headset and alarm clock 10 comprises two substantially cylindrical earpieces 12 coupled by a resilient adjustable metal headband 30. Each of the earpieces 12 has an inner surface 12I which presses against the head of a user while being deployed, and has an outer surface 12E. Each earpiece 12 has a cover 16 that fits snugly over the earpiece 12. In particular, the cover 16 has an inner surface 16I which presses substantially flush against the inner surface 12I of the earpiece 12, and has an outer surface 16E which presses substantially flush against the outer surface 12I of the earpiece 12. The cover 16 may be constructed from plastic. The inner surface 16I of the cover 16 is reinforced with padding material 16P such as foam or rubber for blocking out noise, and also for providing comfort for the user as the resilient headband 14 presses the earpieces 12 against the user's head.

The headband 30 has two sections, namely a first section 32A and a second section 32B, wherein the section 32A selectively telescopes into the section 32B, in order to shorten the overall length of the headband 30 so that it may be suitably used by users having heads of different sizes, and also so that it may be compactly stored when not in use. The sections 32A, 32B are each connected to a different earpiece 12 by a hinge pin 33, which allows the earpiece 12 to selectively swivel towards the section 32A or 32B to which it is attached, also so that the combination headset and alarm clock 10 may be compactly stored.

One of the earpieces 12 contains a small, circular alarm clock 40 having an audible alarm 42 that emits a soft buzzing sound upon selective activation. It is additionally contemplated that the audible alarm 42 may emit a bell-like sound upon selective activation. The audible alarm 42 is positioned in proximity to the inner surface 12I of the earpiece 12 in order that the sound waves emitted therefrom will be more proximal to the user's ear and therefore be more easily heard.

The alarm clock 40 has a face plate 40F having a minute hand 44 and an hour hand 46 extending therefrom, for indicating current time. The face plate 40F further has a time set knob 57, for allowing the user to selectively change the position of the minute hand 44 and the hour hand 46 when resetting the current time. The alarm clock 40 is selectively powered by at least one battery, and has a battery compartment 40Z for selective containment therein of said at least one battery.

The alarm clock 40 has two modes of operation. In particular, the alarm clock 40 has a timer mode and an alarm clock mode, and has a mode button 52 for selectively alternating between the two modes. The alarm clock 40 additionally has an alarm hand 50, and an alarm set knob 55 for setting the position of the alarm hand 50. While in the alarm clock mode, the user rotates the alarm set knob 55 in order to position the alarm hand 50 at a preset time at which the audible alarm 42 will be activated. For example, setting the alarm hand 50 at six o'clock will cause the alarm 42 to ring when the current time becomes six o'clock. While in the timer mode, the user utilizes the alarm set knob 55 to position the alarm hand 50 at a particular number of minutes past the hour corresponding to the time interval after which the audible alarm 42 will be activated. For example, while in the timer mode, setting the alarm hand 50 at twenty minutes past the hour will cause the alarm 42 to ring after a period of twenty minutes has elapsed. The alarm clock 40 is provided with an alarm stop button 54 having an extended position and a depressed position. The alarm stop button 54 is used for selectively activating the alarm 42, and for deactivating the audible alarm 42 after it has been activated to emit the audible alert.

The outer surface 16E of the cover 16 which encloses the earpiece 12 which has the alarm clock 40 has a circular opening 15 and has a flap 13 for selectively covering the opening 15 and thereby obscuring the face plate 40F of the alarm clock 40.

The combination headset and alarm clock 10 is provided with a storage pouch 66 for selectively storing the combination headset and alarm clock 10 in between successive uses. The storage pouch 66 is preferably constructed from nylon and has an opening 68 that is selectively pulled closed by a drawstring 70.

In use, a user lifts the flap 13 and thereby reveals the face plate 40F of the alarm clock 40, and the buttons, 52 and 54, and the knobs, 55, 57, thereon. The user sets the position of the minute hand 44 and the hour hand 46 to the current time with the time set knob 57. In order to set a predetermined time at which the alarm 42 will emit an audible alert, the user first selects one of the two available modes using the mode button 52. In particular, the user presses the mode button 52 a first time to switch to the alarm clock mode. While in the alarm clock mode, the user rotates the alarm set knob 55 in order to position the alarm hand 50 at a preset time at which the audible alarm 42 will be activated. The user may alternately decide to have the alarm 42 be activated after a particular time interval has elapsed. If so, the user presses the mode button 52 a second time in order to switch to the timer mode. While in the timer mode, the user rotates the alarm set knob 55 in order to position the alarm hand 50 at a particular number of minutes past the hour corresponding to a preset time interval after which the audible alarm 42 will be activated. After setting the preset time or preset time interval at which the alarm 42 will be activated, the user extends the alarm stop button 54 in order to activate the alarm 42 to ring at the predetermined time. The user extends the combination headset and alarm clock 10 over the head of the user and covers the user's ears with the earpieces 12. The user selectively telescopes the section 32A into or out of the section 32B in order to achieve an overall length of the headband 30 that is suitable for the particular head size of the user. The user then reads or naps in silence, confident in the knowledge that the audible alarm 42 will awaken or alert the user when the preset time is reached, or after the preset time interval has elapsed, depending on whether the alarm clock 40 is in the alarm clock mode or the timer mode, respectively. After the alarm 42 has been selectively activated to emit an audible alert, the user depresses the alarm stop button 54 in order to deactivate the alarm 42. After the user has finished using the combination headset and alarm clock 10, the user selectively telescopes the section 32A into the section 32B in order to achieve the smallest possible length of the headband 30, and swivels the earpieces 12 towards the section, 32A or 32B, to which they are attached, in order that the combination headset and alarm clock 10 may be compactly stored.

In conclusion, herein is presented a combination headset and alarm clock, for blocking out ambient noise so that a commuter can sleep or read on a train or subway without distractions, and for waking up or alerting the commuter after a predetermined amount of time has elapsed. The invention is illustrated by example in the drawing figures, and throughout the written description. It should be understood that numerous variations are possible, while adhering to the inventive concept. Such variations are contemplated as being a part of the present invention.

What is claimed is:

1. A combination headset and alarm clock, for use by a user for blocking out ambient noise, and for alerting the user after a predetermined amount of time has elapsed, comprising:

a resilient headband;

two earpieces coupled by the headband, each having an inner surface which presses against the head of the user while being deployed, an outer surface, and a cover that fits snugly over the earpiece, said cover having an inner surface which presses substantially flush against the inner surface of the earpiece, and an outer surface which presses substantially flush against the outer surface of the earpiece, wherein the inner surface of the cover is reinforced with padding material for blocking out noise, and for providing comfort for the user as the resilient headband presses the earpieces against the head of the user; and an alarm clock contained within one of the earpieces, having an alarm that emits an audible alert upon selective activation, said alarm clock having a face plate having a minute hand and an hour hand extending therefrom, for indicating current time, said face plate further having a time set knob for allowing the user to selectively change the position of the minute hand and the hour hand when resetting the current time, said alarm clock having a timer mode, an alarm clock mode, and a mode button for selectively alternating between the timer mode and the alarm clock mode, said alarm clock additionally having an alarm hand and an alarm set knob for setting the position of the alarm hand, wherein while in the alarm clock mode, the user rotates the alarm set knob in order to position the alarm hand at a preset time at which the alarm will be activated, and wherein while in the timer mode, the user utilizes the alarm set knob to position the alarm hand at a particular number of minutes past the hour corresponding to a time interval after which the alarm will be activated, said alarm clock further having an alarm stop button for deactivating the audible alarm after it has been selectively activated.

2. The combination headset and alarm clock as recited in claim 1, wherein the outer surface of the cover which encloses the earpiece which contains the alarm clock has a circular opening, and has a flap for selectively covering the opening and thereby obscuring the face plate of the alarm clock.

3. The combination headset and alarm clock as recited in claim 2, further comprising a storage pouch for selectively storing the combination headset and alarm clock in between successive uses.

4. The combination headset and alarm clock as recited in claim 3, wherein the storage pouch has an opening that is selectively pulled closed by a drawstring.

5. The combination headset and alarm clock as recited in claim 4, wherein the storage pouch is constructed from nylon.

6. The combination headset and alarm clock as recited in claim 5, wherein the headband has a first section which selectively telescopes within a second section, in order to allow the user to adjust the overall length of the headband to fit the head of the user, and also so that the combination headset and alarm clock may be compactly stored when not in use.

7. The combination headset and alarm clock as recited in claim 6, wherein the sections of the headband are each connected to a different earpiece by a hinge pin, thereby allowing each earpiece to selectively swivel towards the section to which it is attached, in order that the combination headset and alarm clock may be more compactly stored.

8. The combination headset and alarm clock as recited in claim 7, wherein the alarm clock is selectively powered by at least one battery, and has a battery compartment for selective containment therein of said at least one battery.

9. The combination headset and alarm clock as recited in claim 8, wherein the audible alarm is positioned in proximity to the inner surface of the earpiece in order that it may be more easily heard by the user.

10. The combination headset and alarm clock as recited in claim 9, wherein the padding material of the earpiece is constructed from a member of a class of materials consisting of foam and rubber.

11. The combination headset and alarm clock as recited in claim 10, wherein the covers are constructed from plastic.

12. The combination headset and alarm clock as recited in claim 11, wherein the headband is constructed from metal.

13. The combination headset and alarm clock as recited in claim 12, wherein the audible alarm emits a soft buzzing sound upon selective activation.

14. The combination headset and alarm clock as recited in claim 12, wherein the audible alarm emits a bell-like sound upon selective activation.

15. A method, for use by a user for blocking out ambient noise and for alerting the user after a predetermined amount of time has elapsed, said method using a combination headset and alarm clock having two earpieces coupled by a headband, one of the earpieces having an alarm clock having an alarm that emits an audible alert upon selective activation after a predetermined time has been reached, said alarm clock having a minute hand, an hour hand, and a time set knob, said alarm clock having a timer mode, an alarm clock mode, and a mode button for selectively alternating between the timer mode and the alarm clock mode, said alarm clock additionally having an alarm hand and an alarm set knob for setting the position of the alarm hand, said alarm clock further having an alarm stop button for deactivating the audible alarm after it has been selectively activated, said method comprising the steps of:

setting the position of the minute hand and the hour hand to the current time with the time set knob;

setting the predetermined time at which the audible alarm will be activated by one of the following two methods:

setting the predetermined time by pressing the mode button a first time to switch to the alarm clock mode, and then by rotating the alarm set knob while in the alarm clock mode, in order to position the alarm hand at the predetermined time at which the audible alarm will be activated; and setting a predetermined time interval after which the audible alarm will be activated by pressing the mode button a second time in order to switch to the timer mode, and then by rotating the alarm set knob while in the timer mode, in order to position the alarm hand at a particular number of minutes past the hour corresponding to the predetermined time interval after which the audible alarm will be activated; and extending the alarm stop button;

extending the headband over the head of the user and covering the ears of the user with the earpieces and thereby blocking out ambient sound;

emitting the audible alert by the alarm after the predetermined amount of time has passed;

depressing the alarm stop button by the user in order to deactivate the alarm; and removing the combination headset and alarm clock from the head of the user after use is completed.

16. The method as recited in claim 15, wherein the outer surface of the cover which encloses the earpiece which contains the alarm clock has a circular opening, and has a flap for selectively covering the opening and thereby obscuring the alarm clock, wherein the step of setting the position of the minute hand and the hour hand to the current time is preceded by the step of lifting the flap and thereby revealing the alarm clock.

17. The method as recited in claim 16, wherein the headband has a first section which selectively telescopes within a second section, wherein the sections of the headband are each connected to a different earpiece by a hinge pin, wherein the step of extending the headband over the head of the user and covering the ears of the user with the earpieces is preceded by the step of telescoping the first section within the second section in order to adjust the overall length of the headband so that it will fit the user, and wherein the step of removing the combination headset and alarm clock from the head of the user is followed by the step of compactly storing the combination headset and alarm clock by telescoping the first section into the second section, and by swiveling each of the earpieces on their hinge pins towards the section of the headband to which they are attached, in order to minimize storage volume.

* * * * *